US008888238B2

(12) United States Patent
Naruse et al.

(10) Patent No.: US 8,888,238 B2
(45) Date of Patent: Nov. 18, 2014

(54) IMAGE FORMING APPARATUS

(75) Inventors: Shinichiro Naruse, Kanagawa (JP); Takayuki Niihara, Kanagawa (JP); Kenji Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 132 days.

(21) Appl. No.: 13/483,839

(22) Filed: May 30, 2012

(65) Prior Publication Data

US 2012/0306970 A1 Dec. 6, 2012

(30) Foreign Application Priority Data

Jun. 3, 2011 (JP) ..... 2011-125035

(51) Int. Cl.
*B41J 23/00* (2006.01)
*B41J 25/308* (2006.01)

(52) U.S. Cl.
CPC ..... *B41J 25/3086* (2013.01)
USPC ..... 347/37

(58) Field of Classification Search
CPC ..... B41J 2/17543; B41J 1/243; B41J 1/246; B41J 2/1752; B41J 2/17553
USPC ..... 347/8, 86
See application file for complete search history.

(56) References Cited

U.S. PATENT DOCUMENTS 3,960,256 A * 6/1976 Bickoff et al. ..... 400/59
5,177,505 A * 1/1993 Sugiura et al. ..... 347/22
5,751,301 A * 5/1998 Saikawa et al. ..... 347/8
5,825,381 A * 10/1998 Choo ..... 347/37
6,027,209 A * 2/2000 Menendez et al. ..... 347/85
6,068,374 A * 5/2000 Kurata et al. ..... 347/108
6,137,503 A * 10/2000 Hashimoto et al. ..... 347/19
6,421,073 B1 * 7/2002 Dietel et al. ..... 347/110
6,789,966 B2 9/2004 Tanaka et al.
6,802,600 B2 * 10/2004 Park ..... 347/85
7,008,052 B2 * 3/2006 Yamada et al. ..... 347/85
7,101,019 B2 * 9/2006 Inoue et al. ..... 347/37
7,128,391 B2 * 10/2006 Meadows et al. ..... 347/37
7,578,572 B2 8/2009 Naruse
7,784,900 B2 8/2010 Naruse
2002/0135634 A1 * 9/2002 Lodal et al. ..... 347/37

(Continued)

FOREIGN PATENT DOCUMENTS

JP 10-181150 7/1998
JP 2001-334652 12/2001

(Continued)

OTHER PUBLICATIONS

U.S. Appl. No. 13/476,169, filed May 21, 2012, Niihara et al.

(Continued)

*Primary Examiner* — Matthew Luu
*Assistant Examiner* — Patrick King
(74) *Attorney, Agent, or Firm* — Cooper & Dunham LLP

(57) ABSTRACT

An image forming apparatus includes a recording head including plural nozzles discharging liquid droplets, a head holder holding the recording head, a carriage holding the head holder, a guide member extending in a main scanning direction of the image forming apparatus, and a reference member extending in the direction substantially parallel to the direction of the guide member. Further, the carriage moves along the guide member, a part of the reference member is disposed in the carriage, and the head holder is attachably and detachably hooked on and held by the reference member.

6 Claims, 16 Drawing Sheets

(56) References Cited

U.S. PATENT DOCUMENTS

| | | | | |
|---|---|---|---|---|
| 2004/0206666 | A1* | 10/2004 | Adams | 208/27 |
| 2005/0152776 | A1* | 7/2005 | Coxhead | 415/119 |
| 2005/0253880 | A1* | 11/2005 | Nakamura et al. | 347/8 |
| 2008/0024531 | A1* | 1/2008 | Bastani et al. | 347/8 |
| 2010/0231643 | A1 | 9/2010 | Saiga et al. | |
| 2010/0295897 | A1 | 11/2010 | Naruse et al. | |
| 2011/0134187 | A1 | 6/2011 | Naruse et al. | |
| 2011/0134190 | A1 | 6/2011 | Mase et al. | |
| 2011/0141192 | A1 | 6/2011 | Komuro et al. | |
| 2011/0199410 | A1 | 8/2011 | Mase et al. | |
| 2011/0205299 | A1 | 8/2011 | Naruse et al. | |
| 2011/0216111 | A1* | 9/2011 | Katoh | 347/6 |
| 2011/0216113 | A1* | 9/2011 | Yorimoto et al. | 347/9 |
| 2012/0062649 | A1 | 3/2012 | Naruse et al. | |

FOREIGN PATENT DOCUMENTS

| | | |
|---|---|---|
| JP | 2002-347300 | 12/2002 |
| JP | 2007-276289 | 10/2007 |
| JP | 2010-30270 | 2/2010 |
| JP | 2011-37235 | 2/2011 |

OTHER PUBLICATIONS

U.S. Appl. No. 13/476,164, filed May 21, 2012, Shimizu et al.

* cited by examiner

IMAGE FORMING APPARATUS

CROSS-REFERENCE TO RELATED APPLICATIONS

The present application claims priority under 35 U.S.C §119 to Japanese Patent Application No. 2011-125035 filed Jun. 3, 2011, the entire contents of which are hereby incorporated herein by reference.

BACKGROUND OF THE INVENTION

1. Field of the Invention

The present invention generally relates to an image forming apparatus.

2. Description of the Related Art

As an image forming apparatus including a printer, a facsimile machine, a copier, a plotter, and a multifunctional peripheral, there has been known an inkjet recording apparatus or the like as an image forming apparatus employing a liquid discharge recording method in which a liquid discharge head (a liquid droplet discharge head) discharging liquid droplets is used as a recording head.

When an image is formed in the image forming apparatus employing the liquid discharge recording method, the image quality may vary greatly depending on the droplet placement accuracy of liquid droplets discharged from the nozzles onto a recording sheet. Namely, when the droplet placement accuracy of the liquid droplets is not sufficient, the image quality may be degraded. Therefore, it may be desirable to accurately determine the position of the recording head.

Further, when, for example, a discharge failure occurs in the recording head, it may also be desirable for a user to easily exchange the failed recording head under the using environment. In this case, it is also desirable that the position of the exchanged recording head be accurately and easily determined with higher repeatability (reliability).

In related art, as a method of improving the position determination accuracy of the recording head when the recording head is to be exchanged, there has been known a method in which a head holder and a carriage are provided, the head holder including plural liquid discharge heads and being detachably supported (held) by the carriage. The head holder further includes a position determination part that is in contact with a position determination reference in the carriage scanning direction and the sheet feeding direction, the position determination reference being provided in the carriage. Then, the position determination part serves as the position determination reference relative to the head holder having the liquid discharge heads (see, Japanese Laid-open Patent Application No. 2011-037235).

In Japanese Laid-open Patent Application No. 2011-037235, however, the position of the head holder relative to the carriage is determined using the position determination surface and the position determination pin. Therefore, the configuration may become complicated. Further, when there are plural head holders, it may be required to have separate position determination parts corresponding to the plural head holders. Therefore, it may become much more difficult to determine the mutual positions of the plural head holders. As a result, it may become difficult to exchange the head holders (recording heads) and place new head holders (recording heads) at the correct (appropriate) positions.

The present application is made in light of the above problems, and it may become possible to easily determine the position of the head holder (recording head) with high accuracy and make it easier to exchange the head holder (recording head).

SUMMARY OF THE INVENTION

According to an aspect of the present application, an image forming apparatus includes a recording head including plural nozzles discharging liquid droplets, a head holder holding the recording head, a carriage holding the head holder, a guide member extending in a main scanning direction of the image forming apparatus, and a reference member extending in the direction substantially parallel to the direction of the guide member. Further, the carriage is moved along the guide member, a part of the reference member is disposed in the carriage, and the head holder is attachably and detachably hooked on and held by the reference member.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Figure 1:
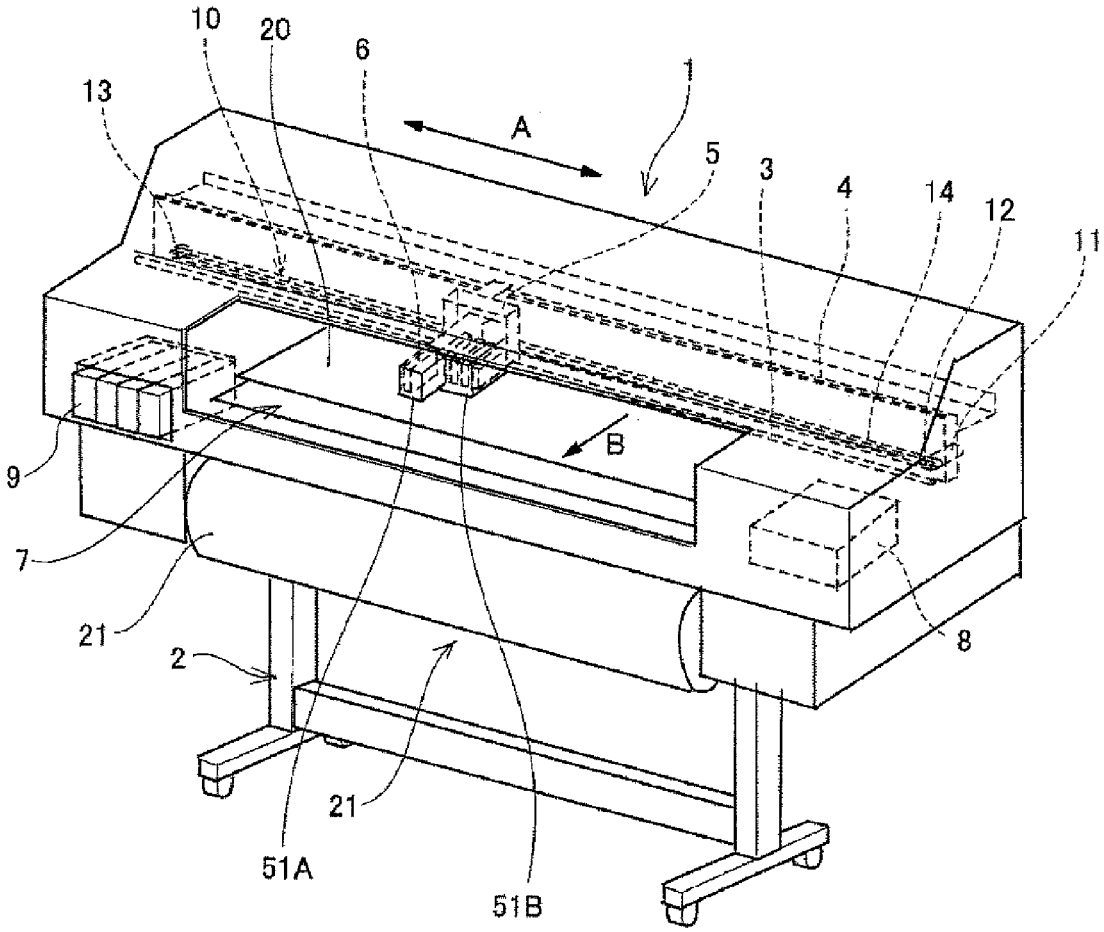
FIG. 1 is a perspective view illustrating an exterior of an entire configuration of an inkjet recording apparatus as an image forming apparatus according to an embodiment of the present application.
Figure 2:
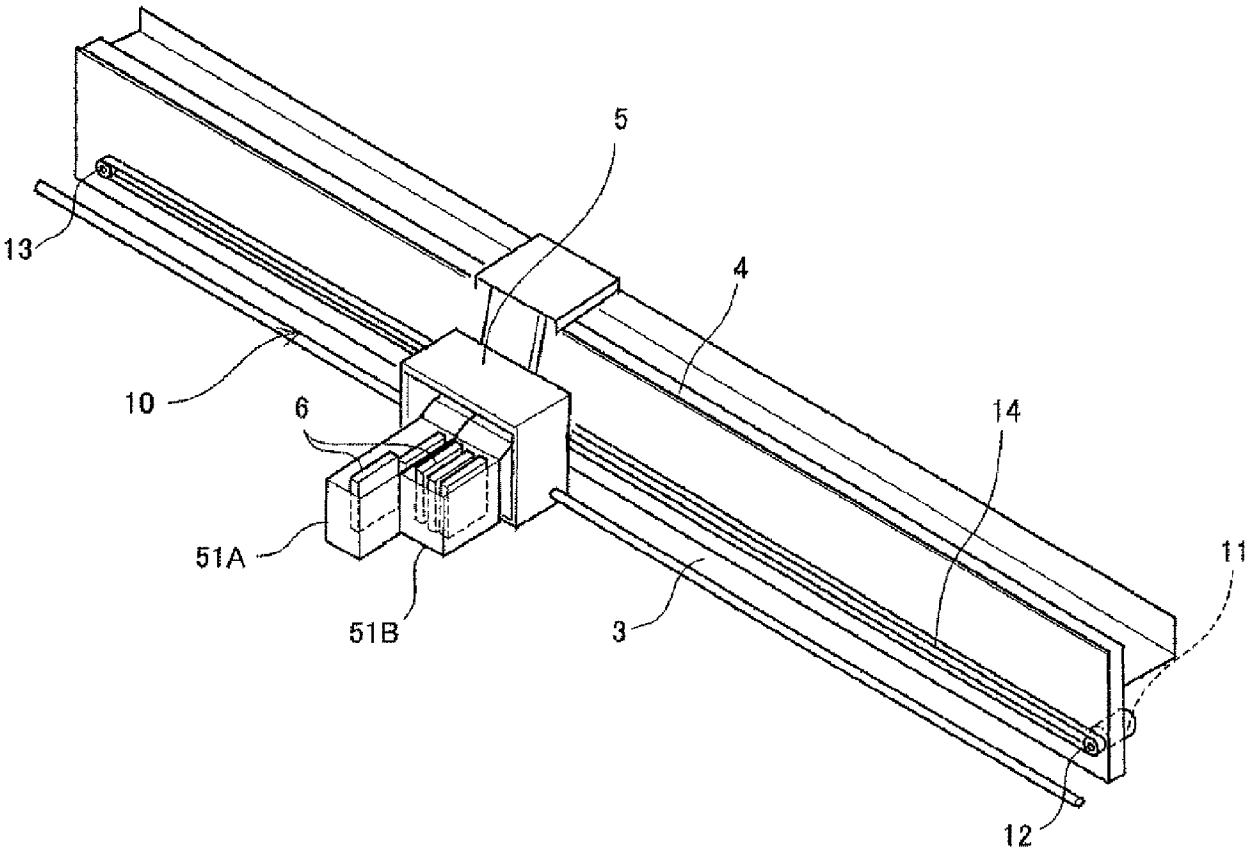
FIG. 2 is a perspective view illustrating a carriage scanning mechanism part of the inkjet recording apparatus.

In the following, embodiments of the present invention are described with reference to the accompanying drawings. First, an example inkjet recording apparatus as an image forming apparatus according to an embodiment of the present invention is described with reference to FIGS. 1 and 2. FIG. 1 is a perspective view illustrating the entire configuration of the inkjet recording apparatus. FIG. 2 is a perspective view illustrating a carriage scanning mechanism part of the inkjet recording apparatus.

The inkjet recording apparatus is a serial-type inkjet recording apparatus, and includes an apparatus main body 1 and a supporting stand 2 supporting the apparatus main body 1.

In the apparatus main body 1, there are a guide rod 3 serving as a guide member and a guide stay 4 provided between side plates (not shown) of the apparatus main body 1. Further, a carriage 5 is slidably supported (held) by the guide rod 3 and the guide stay 4, so as to be moved in the arrow A direction (FIG. 1).

In the carriage 5, there are mounted recording heads 6 including the respective liquid discharge heads discharging color inks of black (K), yellow (Y), magenta (M), and cyan (C). Further, there are integrally provided head tanks (not shown) supplying the color inks to the recording heads 6.

Further, in order to move and scan the carriage 5, there is provided a main scanning mechanism part 10. The main scanning mechanism part 10 includes a driving motor 11, a driving pulley 12, a following pulley 13, and a timing belt 14. The driving motor 11 is disposed on one end side in the main scanning direction. The driving pulley 12 is driven and rotated by the driving motor 11. The following pulley 13 is disposed on the other end side in the main scanning direction. The timing belt 14 is a towing means being provided between the driving pulley 12 and the following pulley 13. Further the following pulley 13 is tensioned toward the outside (i.e., to the direction to separate from the driving pulley 12) by a tension spring (not shown).

In a recording region included in a main scanning region of the carriage 5, sheets (recording sheets) 20 are intermittently fed in the direction orthogonal to the main scanning direction of the carriage 5 (i.e. in the sub scanning direction, the sheet feeding direction, and the arrow B direction) by a suction feeding part 7.

Further, in a region on one end side of the main scanning region, there is disposed a maintenance and recovery mechanism 8 to maintain and recover the recording heads 6. Further, in the outside of a carriage moving region in the main scanning direction or in the other end side of the main scanning region, there is a main tank cartridge 9 attachably and detachably provided on the apparatus main body 1. The main tank cartridge 9 contains color inks to be supplied to the corresponding sub tanks of the recording heads 6.

Further, there is provided a sheet feeding means 21 where a roll sheet (hereinafter simplified as a "sheet") 20 is set. However, another roll sheet having different size in the width direction may alternatively set.

The sheet 20 fed from the sheet feeding means 21 is further fed to the recording region from the rear side to the front side of the apparatus main body 1 by a feeding means (not shown). Then, while the carriage 5 is moved in the main scanning direction and the sheet 20 is intermittently fed by the suction feeding part 7, by driving the recording heads 6 and discharging liquid droplets in accordance with the image information, a desired image may be formed on the sheet 20.

Then, the sheet 20 on which the image is formed is cut so as to have a desired length, and discharged to a discharge tray (not shown) disposed on the front side of the apparatus main body 1.

Figure 3:
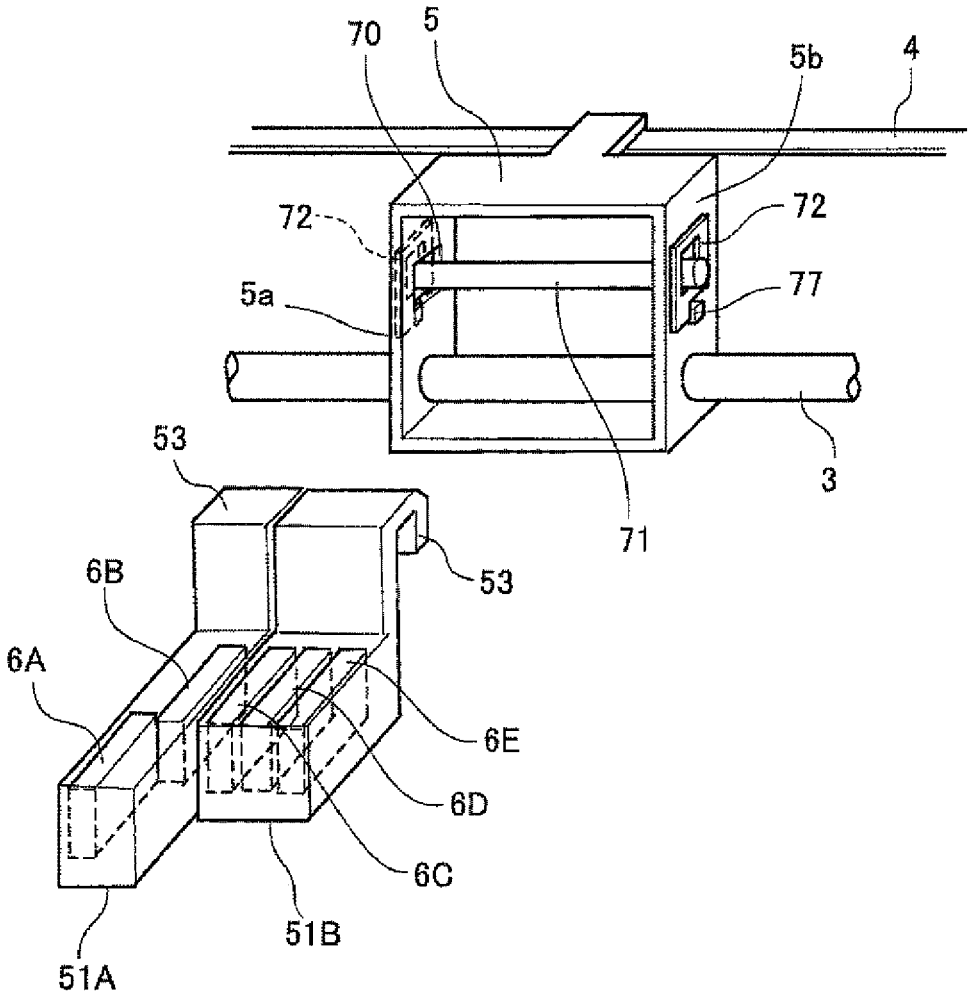
FIG. 3 is a perspective view schematically illustrating a part of the carriage before the head holders are mounted on the carriage according to a first embodiment of the present application.
Figure 4:
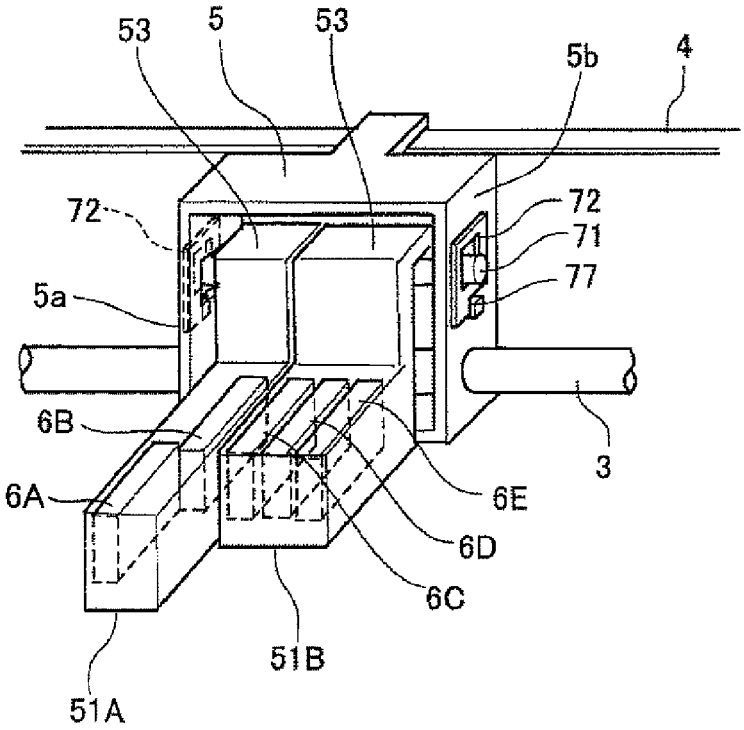
FIG. 4 is a perspective view schematically illustrating the part of the carriage when the head holders are mounted on the carriage in the first embodiment.

Next, an inkjet recording apparatus according to a first embodiment is described with reference to FIGS. 3 and 4. FIG. 3 is a perspective view schematically illustrating a part of the carriage before the head holders are mounted on the carriage. FIG. 4 is a perspective view schematically illustrating the part of the carriage when the head holders are mounted on the carriage.

The carriage 5 includes (holds) a head holder 51A for black color (monochrome) and a head holder 51B for colors.

The head holder 51A includes two recording heads 6A and 6B arranged in a zigzag manner in the sub scanning direction and discharging black ink.

The head holder 51B includes three recording heads 6C, 6D, and 6E arranged in the same position as that of the recording head 6A in the sub scanning direction and discharging yellow, magenta, and cyan liquid droplets, respectively.

Herein, when it is not necessary to distinguish one recording head from another, the recording heads may be collectively referred to as a "recording head 6", as described above. Further, the number of the recording head 6 including the head holders 51A and 51B may be only one.

Here, in the carriage 5, as a reference member, there is a reference axle member 71 provided (formed) in the direction same as that of the guide rod 3. Hereinafter, when it is not necessary to distinguish the head holder 51A from the head holder 51B, a term "head holder 51" may be used. The head holder 51 includes a hooking part 53 having a hook shape so that the head holder 51 is attachably and detachably mounted (hooked) on the reference axle member 71.

By doing this, the head holder 51 is held (supported) by the carriage 5. Here, the reference axle member 71 may have a cylindrical shape or a polygonal shape as the shape of the cross-sectional surface orthogonal to the longitudinal (extending) direction of the reference axle member 71.

As described above, by arranging the reference axle member 71 in the direction same as that of the guide rod (guide member) 3 of the carriage 5, accuracies of the positions (positional accuracy) in the sub scanning direction, height direction, tilting direction, and main scanning direction may be improved.

Figure 5:
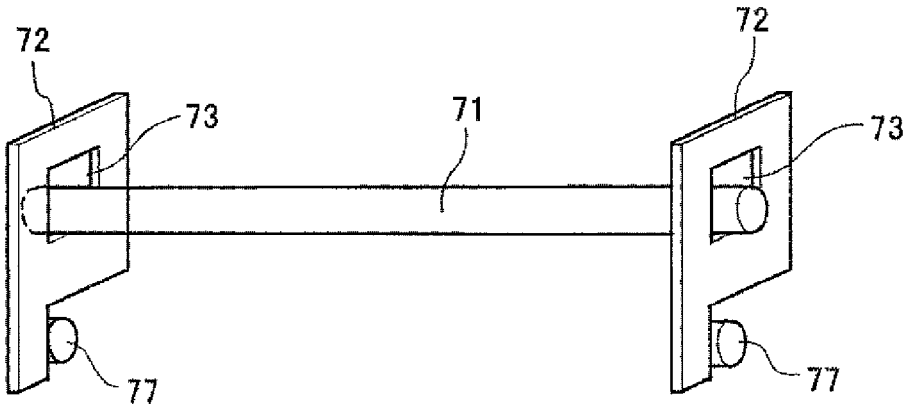
FIG. 5 is a perspective view illustrating a holding mechanism of a reference axle member relative to the carriage in the first embodiment.
Figure 6:
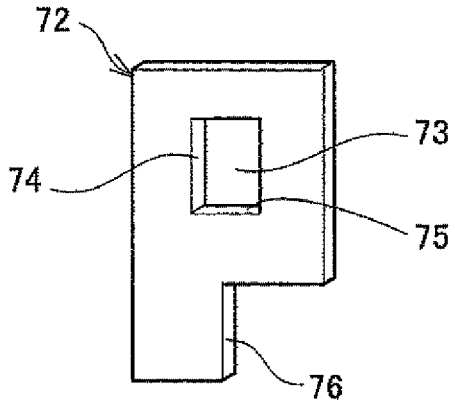
FIG. 6 is a front view of a position adjustment member in the first embodiment.

Next, a structure (mechanism) of holding the reference axle member 71 on the carriage 5 is described with reference to FIGS. 5 and 6. FIG. 5 is a perspective view illustrating the holding mechanism of the reference axle member 71 relative to the carriage in the first embodiment. FIG. 6 is a front view of a position adjustment member 72 in the first embodiment.

The reference axle member 71 is disposed between and passed through through holes 70 (FIG. 3) with a certain allowance (looseness) (i.e., the size of the through hole 70 is larger than the cross section of the reference axle member 71). Further, both of the end parts of the reference axle member 71 are held by the respective position adjustment members 72 which are fixed to the side wall parts 5*a* and 5*b* disposed on the ends of the carriage 5 in the main scanning direction.

As described in FIG. 6, the position adjustment member 72 is a plate-like member, and includes a through hole 73 for position determination. The through hole 73 has a rectangular shape, so that the reference axle member 71 passes through the through hole 73. A wall surface which is on the downstream side in the sub scanning direction and which is one of the sides of the through hole 73 serves as a position determination surface 74 to determine the position of the reference axle member 71 in the sub scanning direction.

Further, a wall surface which is on the lower side in the height direction orthogonal to the direction of the position determination surface 74 and which is one side other than the position determination surface 74 of the through hole 73 serves as a position determination surface 75 to determine the position of the reference axle member 71 in the height direction.

Further, the position adjustment member 72 includes a cutout part formed in the height direction. A wall surface in the vertical (height) direction of the cutout part determines the position in the rotating direction of the position adjustment member 72 when the reference axle member 71 is in contact with the position determination surfaces 74 and 75.

Namely, the wall surface serves as a position determination surface 76 to determine (fix) the position of the position adjustment member 72 in the rotating direction. The position determination surface 76 of the position adjustment member 72 is in contact with a rotation fixing part 77 formed on each of the side wall parts 5*a* and 5*b* of the carriage 5.

As described above, by disposing the position adjustment members 72 on the both ends of the reference axle member 71, it may become possible to maximize the adjustment length of the reference axle member 71, thereby making it possible to highly-accurately determine the position of the reference axle member 71. Further, by disposing (providing) the two sides that determines the positions of the height direction and the sub scanning direction of the position adjustment member 72, the position of the position adjustment member 72 may be determined by contacting with the sides sandwiching a corner of the through hole 73.

Therefore, it may become possible to highly accurately determine the position of the position adjustment member 72. Further, by disposing the position adjustment members 72 and 72 in parallel, it may become possible to determine the positions of the both ends of the reference axle member 71 in the height direction, the sub scanning direction, and the tilting direction in the same contacting manner as described above. Therefore, it may become possible to highly accurately determine the positions of the reference axle member 71 with a lower cost.

Figure 7:
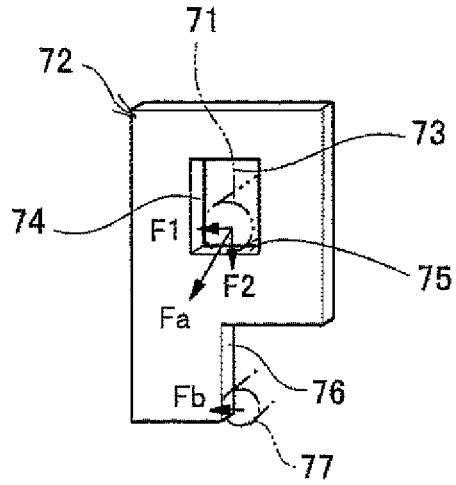
FIG. 7 is a perspective view illustrating pressing forces of the reference axle member relative to the position adjustment member.

Next, the pressing directions of the reference axle member 71 relative to the position adjustment member 72 are described with reference to FIG. 7. FIG. 7 is a perspective view illustrating pressing forces of the reference axle member 71 relative to the position adjustment member 72.

By applying a pressing force in the arrow Fa direction to the reference axle member 71, the reference axle member 71 is in contact with the position determination surfaces 74 and 75. As a result, component forces in the arrow F1 and F2 directions are generated, thereby determining (fixing) the positions of the reference axle member 71 in the sub scanning direction and the height direction.

Further, by applying a pressing force in the arrow Fb direction to the reference axle member 71, the position determination surface 76 of the position adjustment member 72 is pushed to and in contact with the rotation fixing part 77 formed on each of the side wall parts 5*a* and 5*b* of the carriage 5. As a result, the position in the rotating direction of the position adjustment member 72 is determined (fixed).

Further, in this case, an elastic member such as a spring or rubber may be used, so as to apply the pressing force to the reference axle member 71 directly or via the head holders 51A and 51B.

As described above, by pressing (pushing) the reference axle member 71 to the position determination surfaces 74 and 75 in the sub scanning direction and the height direction, respectively, of the position adjustment member 72, it may become possible to reliably contact to the same positions of the same surfaces, and highly accurately determine the positions of the reference axle member 71 relative to the position adjustment member 72.

In this embodiment, in a case of the exchange of the recording head 6, when, for example, the recording heads 6A and 6B are to be exchanged, the head holder 51A is removed from the reference axle member 71, and a new (i.e., exchanged) head holder 51A is hooked on and held by the reference axle member 71.

By doing this, the head position (position of the recording head 6) of the new head holder 51A may be accurately reproduced. Further, a highly accurate position of the new head holder 51A relative to the recording head 6 of the other head holder 51B may also be obtained.

As described above, an image forming apparatus includes a recording head including plural nozzles discharging liquid droplets, a head holder holding the recording head, a carriage holding the head holder, a guide member extending in a main scanning direction of the image forming apparatus, and a reference member extending in the direction substantially parallel to the direction of the guide member.

Further, the carriage moves along the guide member. Further, a part of the reference member is disposed in the carriage. Further, the head holder is attachably and detachably hooked on and held by the reference member.

By having this structure (configuration), it may become possible to easily and highly accurately determine the position of the head holder 51 (recording head 6) and exchange the head holder 51 (recording head 6).

Further, an image forming apparatus may include plural recording heads each including plural nozzles discharging liquid droplets, plural head holders each holding the one or more recording heads, and a reference member extending in a direction substantially parallel to an arranging direction of the plural recording heads. Further, the plural head holders are attachably and detachably hooked on and held by the reference member.

Namely, like a line-type image forming apparatus, plural head holders are commonly hooked on the reference member.

By having this configuration, it may become possible to improve the accuracy of mounting the plural head holders 51 (recording heads 6), easily and highly accurately determine the positions among the plural head holders 51 (recording heads 6), and make it easier to exchange the plural recording heads.

Further, in a case where the position of the reference member is to be highly accurately determined, the number of the recording heads may also be one.

Figure 8:
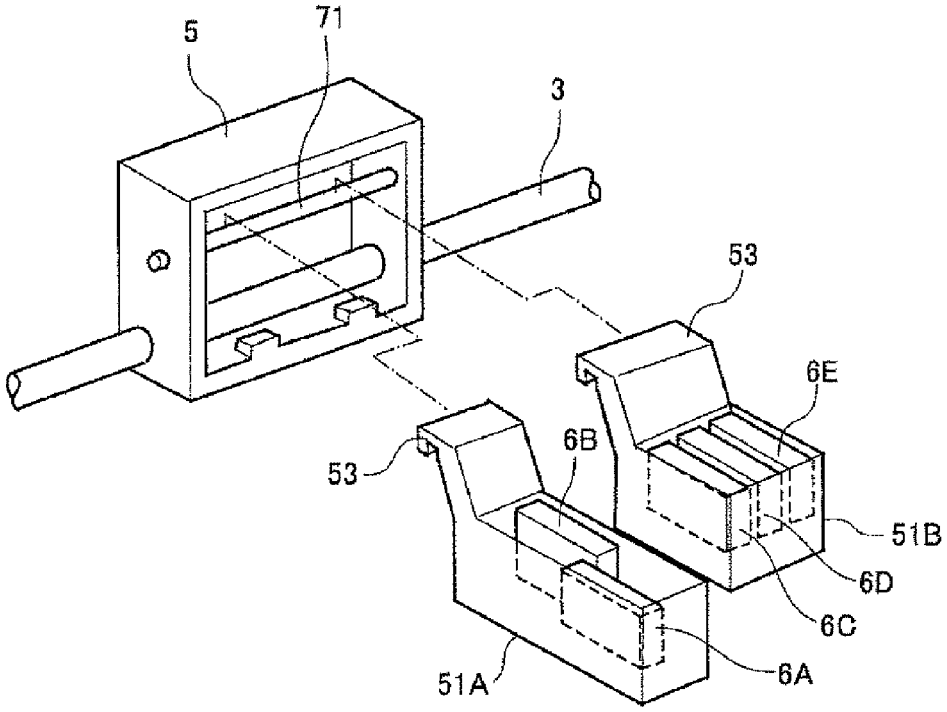
FIG. 8 is a perspective view schematically illustrating the part of the carriage before the head holders are mounted on the carriage according to a second embodiment of the present application.
Figure 9:
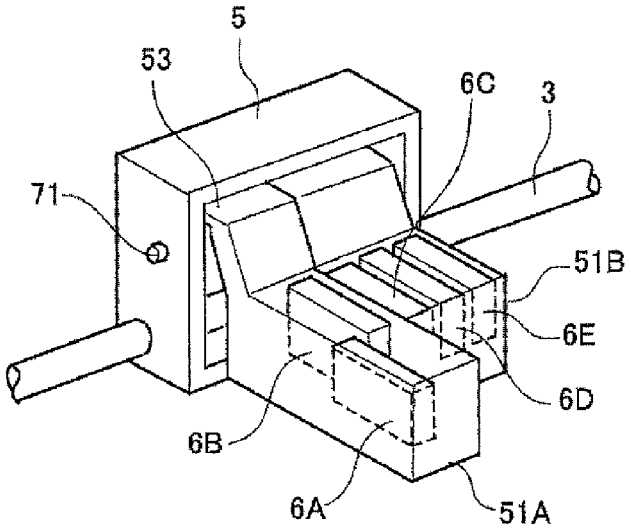
FIG. 9 is a perspective view schematically illustrating the part of the carriage when the head holders are mounted on the carriage in the second embodiment.

Next, a second embodiment of the present invention is described with reference to FIGS. 8 through 11. FIG. 8 is a perspective view schematically illustrating the part of the carriage before the head holders are mounted on the carriage according to the second embodiment. FIG. 9 is a perspective view schematically illustrating the part of the carriage when the head holders are mounted on the carriage in the second embodiment.

Figure 10:
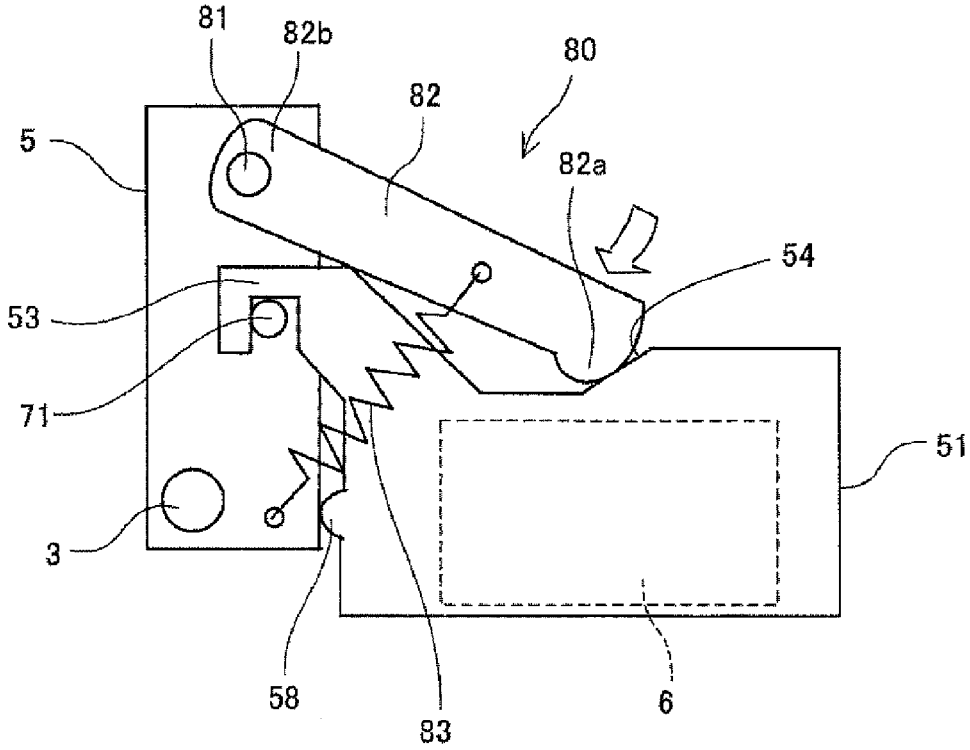
FIG. 10 is a side view illustrating a pressing mechanism provided in the part of the carriage according to the second embodiment.
Figure 11:
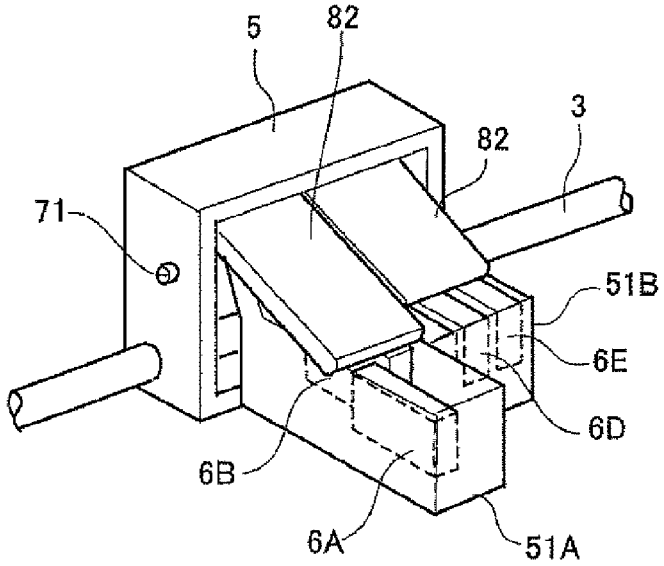
FIG. 11 is a perspective view schematically illustrating a state where a pressing member of the pressing mechanism is provided in the second embodiment.

FIG. 10 is a side view illustrating a pressing structure (mechanism) provided in the part of the carriage according to the second embodiment. FIG. 11 is a perspective view schematically illustrating a state where a pressing member of the pressing mechanism is imposed in the second embodiment;

In this embodiment, similar to the first embodiment, in the carriage 5, there is provided the reference axle member 71, which is a reference member, disposed (extending) in the same direction of the guide rod 3. Further, the head holders 51A and 51B includes respective hooking parts 53 to be attachably and detachably hooked on the reference axle member 71. The head holders 51A and 51B may be rotatably mounted (held) relative to the carriage 5 by hooking the hooking parts 53 of the head holders 51A and 51B on the reference axle member 71.

Further, as schematically illustrated in FIG. 10, each of the head holders 51A and 51B includes at least one protruding part 58 to be in contact with the carriage 5. FIG. 10 schematically illustrates a case where the number of the protruding part 58 of the head holder 51 is one. However, the number of the protruding parts 58 of the head holder 51 may be two or more. For example, the head holder 51 may include two protruding parts 58 at respective distal ends in the main scanning direction.

Here, as illustrated in FIG. 10, an inclined surface 54 is formed at, for example, both ends on the upper end surface of the head holder 51.

Further, there is provided a pressing mechanism 80 rotatably pressing the head holder 51 to the carriage 5 side by using the reference axle member 71 as the center of the rotation.

The pressing mechanism 80 includes a pressing member 82 including a back end part 82*b* which is rotatably supported by an axle 81. As schematically illustrated in FIG. 11, the pressing member 82 has, for example, a plate-like shape. The pressing member 82 includes a front end part 82*a*. From the upper side, the front end part 82*a* is in contact with inclined surface 54 formed on the upper end surface of the head holder 51.

Further, an elastic member 83 such as a helical extension spring is provided between the pressing member 82 and the carriage 5. Due to the biasing force by the elastic member 83, the front end part 82*a* of the pressing member 82 presses (pushes) the inclined surface 54 of the head holder 51 in the white arrow direction.

By doing this, the head holder 51 is rotatably biased to the reference axle member 71 and the carriage 5 by the pressing member 82 in the clockwise direction (white arrow direction) with the reference axle member 71 being the center of the rotation of the head holder 51.

Therefore, the positions of the head holders 51A and 51B relative to the carriage 5 are determined. Namely, it may become possible to determine the position of the head holder 51 simply by hooking the head holder 51 on the reference axle member 71 (by a user) and applying a pressing force to only one part.

As a result, even when the recording head (head holder) is exchanged by a user, it may become possible to easily and highly accurately determine the position of the exchanged (a new) recording head and therefore, it may become possible to easily exchange the recording head.

As described above, an image forming apparatus includes a recording head including plural nozzles discharging liquid droplets, a head holder holding the recording head, a carriage holding the head holder, a guide member extending in a main scanning direction of the image forming apparatus, and a reference member extending in the direction substantially parallel to the direction of the guide member.

Further, the carriage moves along the guide member, a part of the reference member is disposed in the carriage, and the head holder is rotatably hooked on and held by the reference member. The image forming apparatus may further include a pressing means for pressing the head holder to the carriage side, so that due to the pressing force by the pressing means the head holder is pressed to the reference member and a member on the carriage side. By doing this, it may become possible to easily and highly accurately determine the position of the recording head (head holder) and make it easier to exchange the recording head.

Further, as described above, the hooking part 53 is formed on the both end parts in the main scanning direction of the head holder 51, and the carriage 5 and the head holder 51 is in contact with each other via one protruding part 58.

Therefore, the position of the head holder 51 relative to the carriage 5 may be determined by using the three points (i.e., two hooking parts 53 and one protruding part 58). By doing this, it may become possible to reliably determine the gap between the recording head 6 and the sheet 20 with a higher accuracy.

Further, by using an axle member (i.e., the reference axle member 71) as a part to hold the head holder 51, it may become possible to reduce the variance (difference) among the parts (due to the simple configuration).

Further, by using the spring member as a means for biasing the pressing member, the cost may be reduced.

Here, example different structures of the reference axle member 71 and the hooking part 53 of the head holder 51 are described with reference to FIGS. 12A through 12C and 13A and 13B. Namely, the figures are enlarged views illustrating different hooking configurations of the head holder and the reference axle member.

Figure 12A:
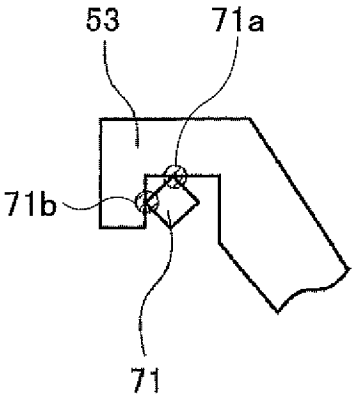
FIGS. 12A through 12C are enlarged views illustrating different hooking configurations of the head holder and the reference axle member.

FIG. 12A illustrates a first example where the cross-sectional surface, orthogonal to the main scanning direction (that is, the axle direction of the reference axle member 71), of the hooking part 53 of the head holder 51 has a rectangular shaped opening formed upward from the bottom one side of the rectangular. Further, the cross-sectional surface orthogonal to the main scanning direction of the reference axle member 71 is rectangular.

Then, the corners 71*a* and 71*b* of the reference axle member 71 are in contact with the respective sides of the hooking part 53 of the head holder 51. In the figures, the hatched parts represent the contacting parts between the reference axle member 71 and the hooking part 53.

Figure 12B:
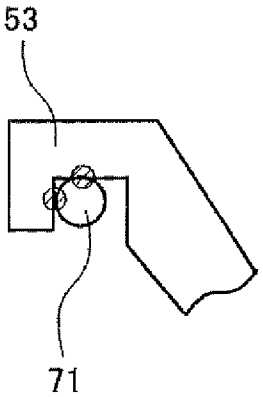

FIG. 12B illustrates a second example where the cross-sectional surface, orthogonal to the main scanning direction (that is, the axle direction of the reference axle member 71), of the hooking part 53 of the head holder 51 has the rectangular shaped opening formed upward from the bottom one side of the rectangular similar to FIG. 12A.

However, the cross-sectional surface orthogonal to the main scanning direction of the reference axle member 71 is circular. Then, two points on the peripheral surface of the reference axle member 71 are in contact with the respective sides of the hooking part 53 of the head holder 51.

Figure 12C:
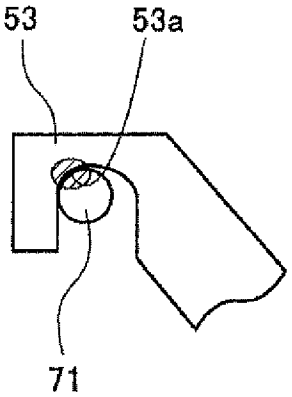

FIG. 12C illustrates a third example where the cross-sectional surface, orthogonal to the main scanning direction (that is, the axle direction of the reference axle member 71), of the hooking part 53 of the head holder 51 has an arc-like shaped.

Further, the cross-sectional surface orthogonal to the main scanning direction of the reference axle member 71 is circular. Then, the peripheral surface of the reference axle member 71 is in contact with the arc-like shaped part of the hooking part 53 of the head holder 51.

In the first example of FIG. 12A, namely when the cross-sectional shape of the reference axle member 71 is rectangular, the contacting conditions between the reference axle member 71 and the head holder 51 may vary depending on the set up angle of the reference axle member 71.

However, in the second and the third examples, due to the cross-sectional circular shape of the reference axle member 71, it may become possible to prevent the variance of the contacting conditions between the reference axle member 71 and the head holder 51 even when the set up angle (a tilt angle) of the reference axle member 71 changes.

As a result, in the second and the third examples (in FIGS. 12B and 12C), it may become possible to reduce the influence of the set up angle of the reference axle member 71 and obtain more stable position of the head holder with compared with the first example (in FIG. 12A).

Figure 13B:
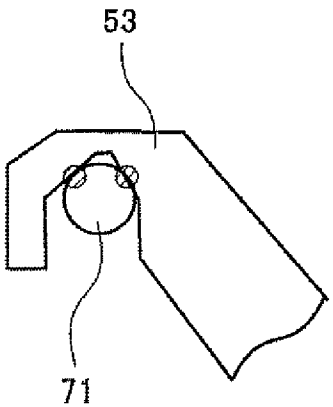
FIGS. 13A and 13B are enlarged views illustrating other different hooking configurations of the head holder and the reference axle member.
Figure 13A:
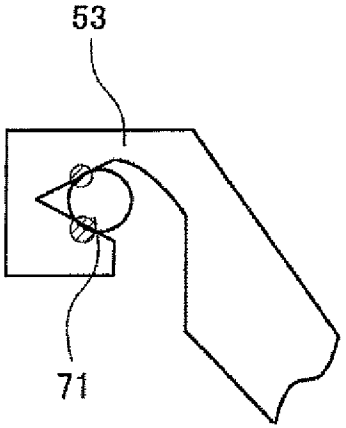

FIG. 13A illustrates a fourth example where the cross-sectional surface, orthogonal to the axle direction of the reference axle member 71, of the hooking part 53 of the head holder 51 has a triangular shape having the opening formed on the side where the recording head 6 is held.

Further, the cross-sectional surface, orthogonal to the axle direction of the reference axle member 71, of the reference axle member 71 has a circular shape. Then, the two sides of the triangle formed on the hooking part 53 of the head holder 51 are in contact with the peripheral surface of the reference axle member 71.

FIG. 13B illustrates a fifth example where the cross-sectional surface, orthogonal to the axle direction of the reference axle member 71, of the hooking part 53 of the head holder 51 has a trapezoidal shape having the opening formed on the lower side. Further, the cross-sectional surface, orthogonal to the axle direction of the reference axle member 71, of the reference axle member 71 has a circular shape.

Then, the two sides of the trapezoidal shape formed on the hooking part 53 of the head holder 51 are in contact with the peripheral surface of the reference axle member 71.

As in the fourth and the fifth examples of FIGS. 13A and 13B, by contacting the reference axle member 71 with the hooking part 53 of the head holder 51 at two points, it may become possible to obtain a more stable position of the head holder.

Next, further different examples of the pressing mechanism are described with reference to FIGS. 14 and 15.

Figure 14:
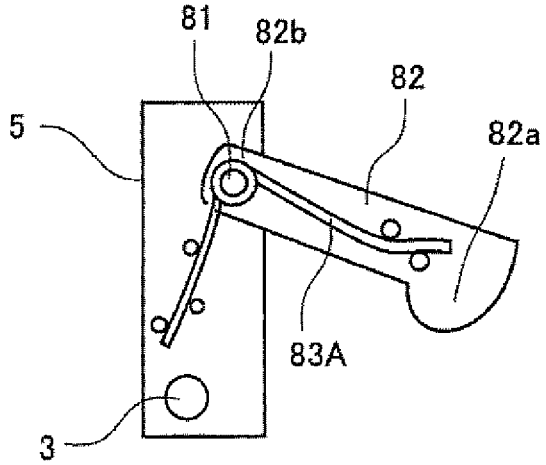
FIG. 14 is a side view illustrating another different example of the pressing mechanism.
Figure 15:
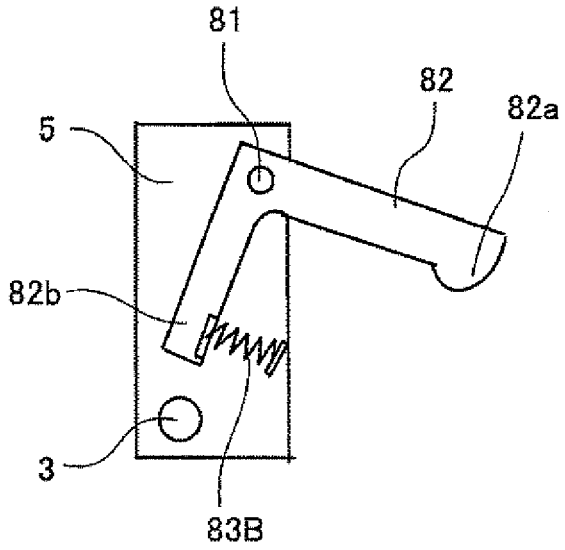
FIG. 15 is a side view illustrating still another different example of the pressing mechanism.

FIGS. 14 and 15 are side views illustrating the first and the fifth different examples, respectively, of the pressing mechanism.

FIG. 14 of the first example illustrates a twisted spring as a biasing means for biasing the pressing member 82.

In the second example of FIG. 15, the pressing member 82 has an "L" shape and a helical extension spring 83B is used as the biasing means.

By using the structures described above, the pressing force may be applied with a lower cost.

Figure 16:
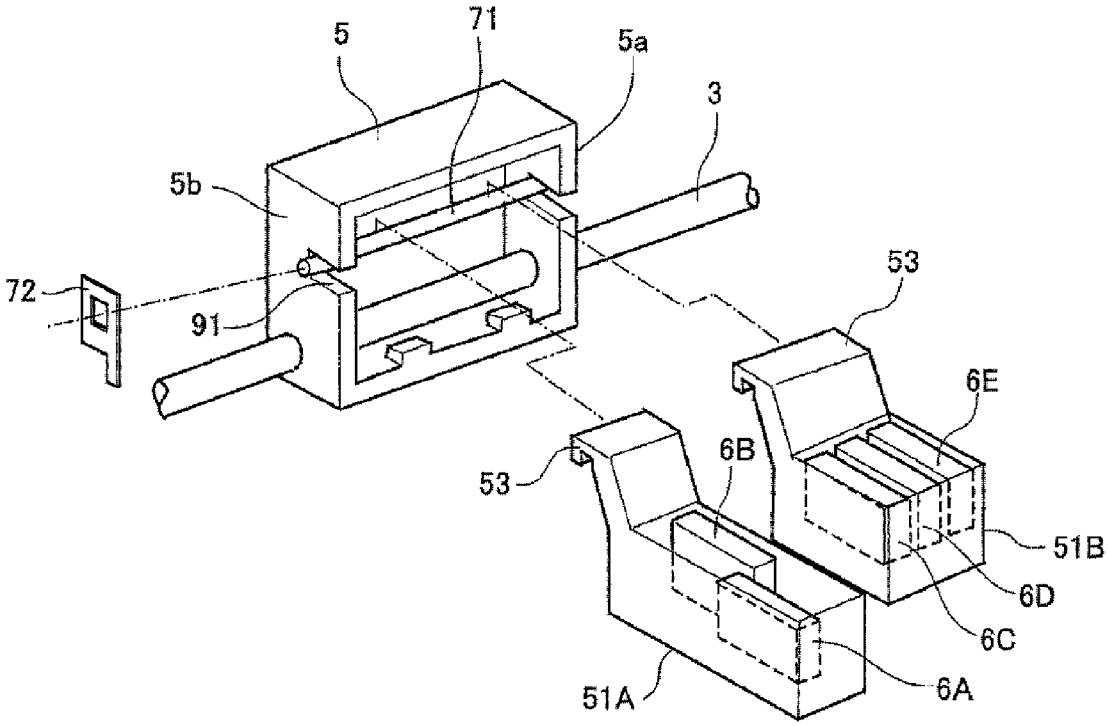
FIG. 16 is a perspective view illustrating the part of the carriage according to a third embodiment.

Next, a third embodiment of the present invention is described with reference to FIG. 16. FIG. 16 is a perspective view illustrating the part of the carriage according to the third embodiment.

In this embodiment, concave parts 91 are formed on the side wall parts 5*a* and 5*b* of the carriage 5, so that the reference axle member 71 is set up (engaged) in and detached from the carriage 5. In this case, the both ends of the reference axle member 71 are held with the carriage 5 by using the position adjustment member 72.

Figure 17:
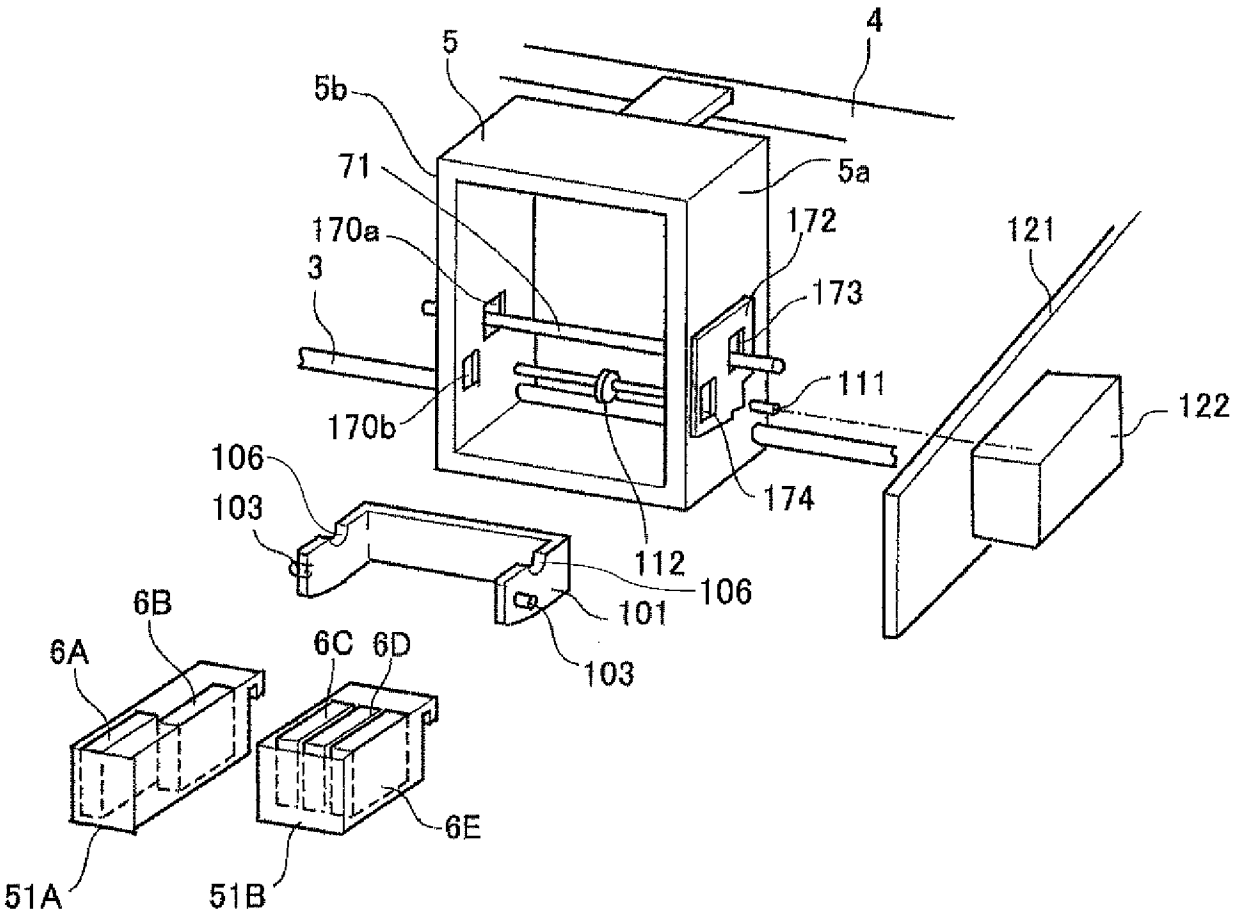
FIG. 17 is a perspective exploded view schematically illustrating the part of the carriage according to a fourth embodiment.
Figure 18:
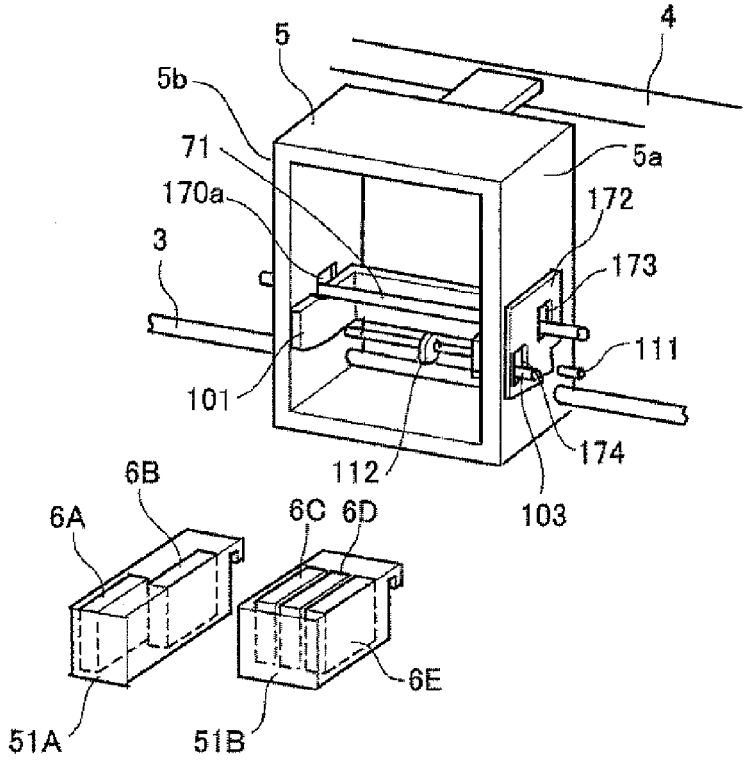
FIG. 18 is a perspective exploded view schematically illustrating the part of the carriage when an intermediate member is positioned in the fourth embodiment.

Next, a fourth embodiment of the present invention is described with reference to FIGS. 17 through 20. FIG. 17 is a perspective exploded view schematically illustrating the part of the carriage. FIG. 18 is a perspective exploded view schematically illustrating the part of the carriage when an intermediate member is positioned.

Figure 19:
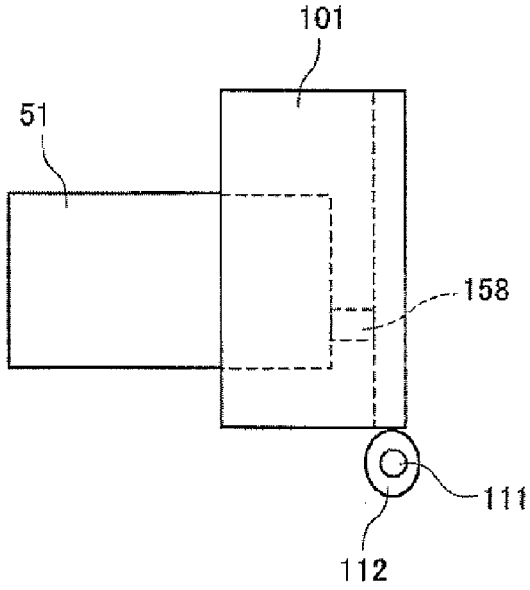
FIG. 19 is a side view schematically illustrating the part of the intermediate member and the head holder in the fourth embodiment.
Figure 20:
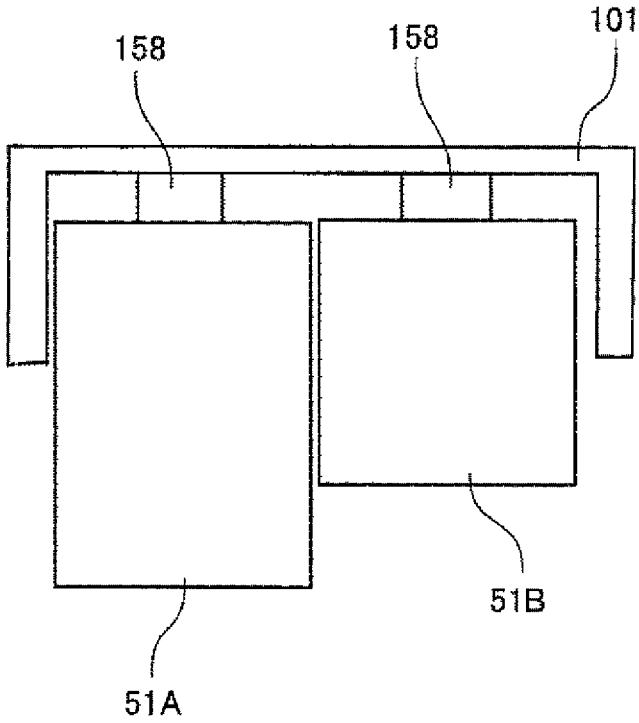
FIG. 20 is a top view schematically illustrating the part of the intermediate member and the head holder in the fourth embodiment.

FIG. 19 is a side view schematically illustrating the part of the intermediate member and the head holder. FIG. 20 is a top view schematically illustrating the part of the intermediate member and the head holder.

In this embodiment as well, the carriage 5 includes through holes 170*a* formed on the respective side wall parts 5*a* and 5*b* of the carriage 5. Further, the reference axle member 71 passes through the through holes 170*a*, and is held by position adjustment members 172 fixed to the respective side wall parts 5*a* and 5*b* of the carriage 5.

The position adjustment members 172 include respective position determination through holes 173 to determine the position of the reference axle member 71.

Further, the position determination through holes 173 serve as guide holes as well for moving up and down the position of the reference axle member 71, so that the reference axle member 71 is movably held in the up-and-down direction by the position determination through holes 173.

Further, in this embodiment, an intermediate member 101 is provided between the reference axle member 71 and the head holders 51A and 51B.

The intermediate member 101 includes supporting axle members 103 extending in the same direction of the reference axle member 71. Further, through holes 170*b* are formed on the respective side wall parts 5*a* and 5*b* of the carriage 5. The supporting axle members 103 passes through the respective through holes 170*b* and is held (supported) by supporting holes 174 formed on the respective position adjustment members 172.

Further, on the intermediate member 101, there are formed concave parts 106 into which the reference axle member 71 is engaged (disposed). Further, the supporting holes 174 formed on the respective position adjustment members 172 serve as guide holes though which the supporting axle members 103 of the intermediate member 101 move in the up-and-down direction, and the supporting axle members 103 are movably supported in the up-and-down direction by the supporting holes 174.

Further, as illustrate in FIGS. 19 and 20, a protruding parts 158 are formed on the intermediate member 101 side of the head holders 51A and 51B so as to be in contact with a wall surface of the intermediate member 101.

On the other hand, on the lower side of the intermediate member 101, a lifting rod 111 is rotatably held relative to the carriage 5. The lifting rod 111 includes one or more lifting cams 112 which may be in contact with the lower surface of the intermediate member 101. As illustrated in FIG. 17, one end part of the lifting rod 111 is rotated by a lifting motor 122 provided on a side plate 121 of the apparatus main-body side.

Figure 21B:
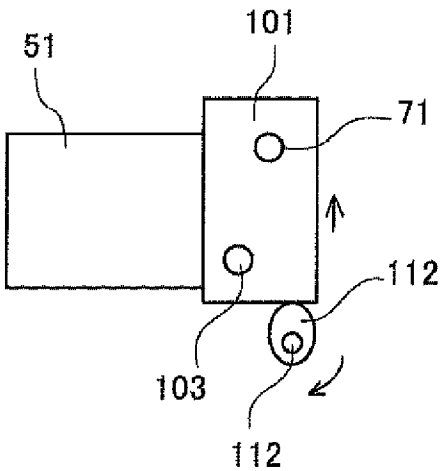
FIGS. 21A and 21B are side views schematically illustrating an elevating operation of the part of the intermediate member and the head holder in the fourth embodiment.
Figure 21A:
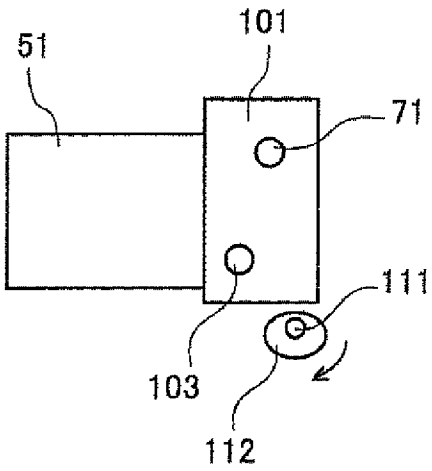

Here, the lifting operation of the head holders 51A and 51B is described with reference to FIGS. 21A and 21B. As illustrated in FIG. 21A, the position where the lifting cam 112 is not in contact with the intermediate member 101 is called an "initial height position". From the initial height position, the lifting cam 112 is rotated in, for example, the arrow direction. Then, as illustrated in FIG. 21B, the lifting cam 112 is in contact with the intermediate member 101 and lifts up the intermediate member 101 in the arrow direction. By doing this, the intermediate member 101 moves (displaces) in upper direction, and the head holder 51 is moved in the direction so as to be separated from the feeding surface of the sheet 20.

As described above, by moving (displacing) the intermediate member 101, the position in the height direction of the head holder 51 may be adjusted. Therefore, it may become possible to adjust the gap between the recording head 6 of the head holders 51A and 51B and the sheet 20.

In this case, to adjust the position in the height direction of the recording head (head holder), the entire carriage is not moved but the intermediate member is moved. Therefore, it may become easier to adjust the gap with a simpler configuration.

Figure 22:
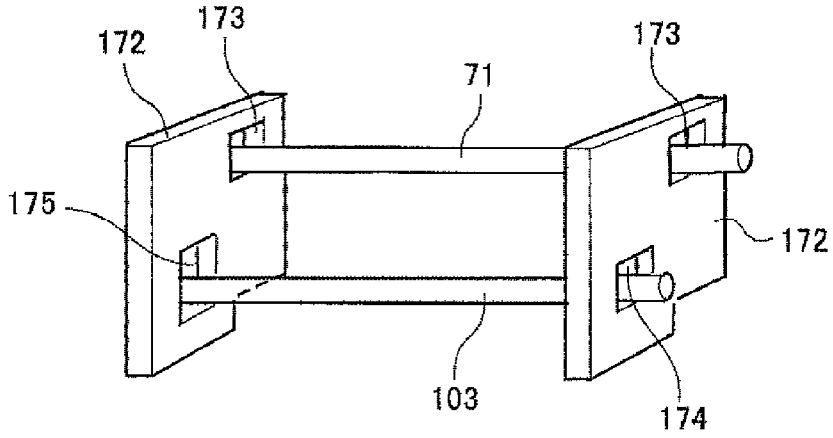
FIG. 22 is a perspective view schematically illustrating a part of the reference axle member and supporting axle members according to a fifth embodiment of the present invention.

Next, a fifth embodiment of the present invention is described with reference to FIG. 22. FIG. 22 is a perspective view schematically illustrating a part of the reference axle member 71 and the supporting axle members 103 of the intermediate member 101 according to a fifth embodiment of the present invention.

In this embodiment, the supporting axle members 103 are provided so as to pass through the intermediate member and held by the position adjustment members 172 fixed to the carriage 5.

In this case, the positions of the both end parts of the reference axle member 71 are determined (fixed) by contacting the respective position determination through holes 173 of the position adjustment members 172. On the other hand, one end side of the supporting axle member 103 is in contact with and held by the wall surface of the supporting hole 174 formed on one position adjustment member 172. However, the other end side of the supporting axle member 103 passes through but is not in contact with a through hole 175 formed on the other position adjustment member 172.

Figure 23:
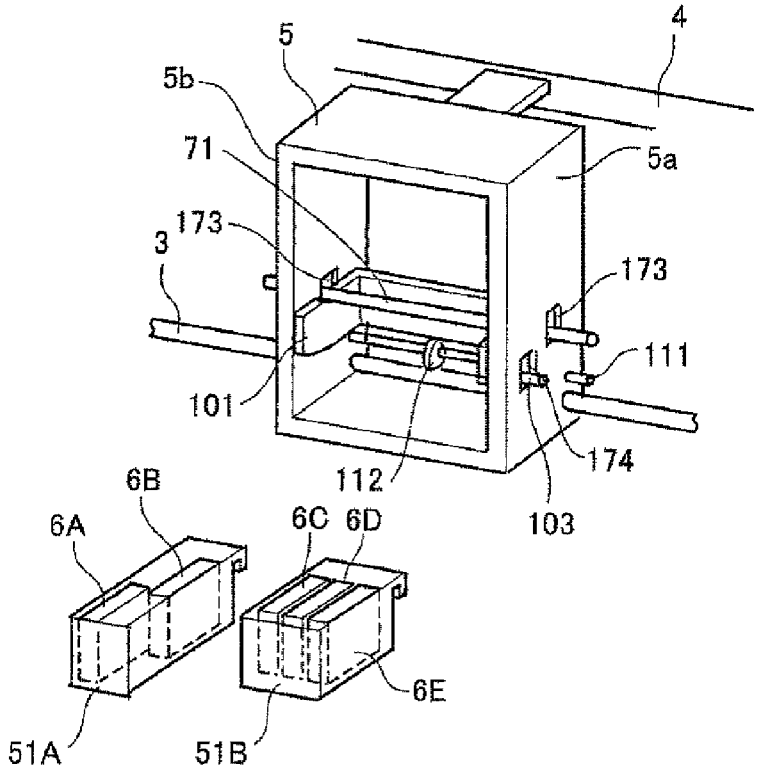
FIG. 23 is a perspective view schematically illustrating the part of the carriage according to a sixth embodiment of the present invention.

Next, a sixth embodiment of the present invention is described with reference to FIG. 23. FIG. 23 is a perspective view schematically illustrating the part of the carriage according to the sixth embodiment.

In this embodiment, the reference axle member 71 and the supporting axle member 103 are directly supported by the carriage 5 in the configuration of the fourth embodiment.

According to an aspect of the present application, an image forming apparatus includes a recording head including plural nozzles discharging liquid droplets, a head holder holding the recording head, a carriage holding the head holder, a guide member extending in a main scanning direction of the image forming apparatus; and a reference member extending in the direction substantially parallel to the direction of the guide member. Further, the carriage is configured to move along the guide member, a part of the reference member is disposed in the carriage, and the head holder is attachably and detachably hooked on and held by the reference member.

According to an embodiment, the image forming apparatus may further includes a position adjustment member adjusting a position of the reference member relative to the carriage.

According to an embodiment, the position adjustment member may be a plate-like shape and may include two sides orthogonal to each other and one side to determine a position in a rotational direction when the reference member is in contact with the two sides.

According to an embodiment, the image forming apparatus may further include a pressing unit pressing the reference member to the two sides.

According to an embodiment, an image forming apparatus include plural recording heads each including plural nozzles discharging liquid droplets, plural head holders each holding the one or more recording heads, and a reference member extending in a direction substantially parallel to an arranging direction of the plural recording heads. Further, the plural head holders are attachably and detachably hooked on and held by the reference member.

By having the configuration as describe above, it may become possible to easily and highly accurately determine the position of the recording head (head holder) and exchange the recording head (head holder) more easily.

In the present application, the material of the "sheet" is not limited to a paper alone. The material of the "sheet" may include, for example, a material of an OHP (Over Head Projector) sheet, fiber (cloth), glass, a substrate and the like to which liquid including ink droplets may be adhered. Further, the "sheet" may be a material called a "medium to be recorded", a "recording medium", a "recording sheet", a "recording paper" and the like. Further, it is assumed that the terms "image forming", "recording", "printing", "print", "image printing" and the like are synonymous words.

Further, the term "image forming apparatus" refers to an apparatus performing an image forming by discharging liquid onto a medium including a paper, strings, fibers, a cloth, leather, a metal, plastic, glass, wood, ceramic and the like. Further, the term "image forming" refers not only to applying an image having a meaning of the character, figure and the like to a medium but also to applying a meaningless image to a medium (e.g., simply discharging liquid droplets to a medium).

The term "ink" is not limited to a liquid called "ink" unless otherwise described and is collectively used to represent all the materials that are called "recording liquid", "fixing treatment liquid", "liquid" and the like and that are used for the image forming. Therefore, the term "ink" may include a "DNA sample", "resist", "pattern material", "resin" and the like.

Further, the "image" is not limited to a planate one but does include an image applied on a medium and the like which are three-dimensionally formed, and an image formed by three-dimensionally molding a solid object.

Further, unless otherwise described, the image forming apparatus includes a serial-type image forming apparatus and a line-type image forming apparatus.

Although the image forming apparatus has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a recording head including plural nozzles discharging liquid droplets;

a head holder configured to hold the recording head;

a carriage configured to hold the head holder;

a guide member extending in a main scanning direction of the image forming apparatus;

a reference member extending in the direction substantially parallel to the main scan direction in which the guide member extends; and a position adjustment member configured to adjust a position of the reference member relative to the carriage, wherein the carriage is configured to move along the guide member, wherein a part of the reference member is disposed in the carriage, and wherein the head holder is attachably and detachably hooked on and held by the reference member, wherein the reference member is disposed to extend in the main scan direction between, and passed through, through-holes in respective side walls of the carriage, and wherein the position adjustment member is a plate-like shape and includes two sides crossing with each other and one side operates as a position determination surface to determine the position of the reference member when the reference member is in contact with the two sides.

2. The image forming apparatus according to claim 1, further comprising:

a pressing unit configured to press the reference member to the two sides.

3. An image forming apparatus comprising:

plural recording heads arranged in an arranging direction and each including plural nozzles discharging liquid droplets;

plural head holders each configured to hold one or more of the recording heads;

a carriage configured to hold the plural head holders;

a reference member extending in a direction substantially parallel to the arranging direction of the plural recording heads; and a position adjustment member configured to adjust a position of the reference member relative to the carriage, wherein the plural head holders are attachably and detachably hooked on and held by the reference member, and wherein the reference member is not a part of any of the plural head holders, and the reference member is disposed to extend, in the direction substantially parallel to the arranging direction of the plural recording heads, between, and passed through, through-holes in respective side walls of the carriage, and wherein the position adjustment member is a plate-like shape and includes two sides orthogonal to each other and one side operates as a position determination surface to determine the position of the reference member when the reference member is in contact with the two sides.

4. The image forming apparatus according to claim 3, further comprising:

plural position adjustment members fixed to the respective side walls of the carriage, to adjust a position of the reference member relative to the carriage, the plural position adjustment members including respective through-holes for determining the position of the reference member, and the reference member that passes through the through-holes is supported by the corresponding position adjustment members.

5. The image forming apparatus according to claim 1, further comprising:

plural position adjustment members fixed to the respective side walls of the carriage, to adjust a position of the reference member relative to the carriage, the plural position adjustment members including respective through-holes for determining the position of the reference member, and the reference member that passes through the through-holes is supported by the corresponding position adjustment members.

6. The image forming apparatus according to claim 1, wherein the head holder includes a hooking part configured to have a hook shape to attachably and detachably hook on the reference member.

* * * * *